US010518574B2

(12) United States Patent
Robinson et al.

(10) Patent No.: US 10,518,574 B2
(45) Date of Patent: Dec. 31, 2019

(54) DUAL PRESSURE CLAM PRESS

(71) Applicant: GroupeSTAHL, Sterling Heights, MI (US)

(72) Inventors: Benjamin Robinson, Carmichaels, PA (US); Richard Antoszewski, Carmichaels, PA (US)

(73) Assignee: STAHLS INC., Sterling Heights, MI (US)

( * ) Notice: Subject to any disclaimer, the term of this patent is extended or adjusted under 35 U.S.C. 154(b) by 761 days.

(21) Appl. No.: 15/054,631

(22) Filed: Feb. 26, 2016

(65) Prior Publication Data

US 2016/0250816 A1 Sep. 1, 2016

Related U.S. Application Data

(60) Provisional application No. 62/121,765, filed on Feb. 27, 2015.

(51) Int. Cl.

| | |
|---|---|
| ***B44C 1/17*** | (2006.01) |
| ***B30B 1/04*** | (2006.01) |
| ***B30B 15/00*** | (2006.01) |
| ***B30B 15/06*** | (2006.01) |

(52) U.S. Cl.

CPC ..... *B44C 1/1729* (2013.01); *B30B 1/04* (2013.01); *B30B 15/0029* (2013.01); *B30B 15/064* (2013.01)

(58) Field of Classification Search

CPC ..... B30B 15/06; B30B 15/067; B30B 15/068; B30B 15/0029; B30B 1/28; B30B 1/04; F16B 2/18; F16B 13/0825; F16B 23/0046

USPC ..... 100/257, 281, 283, 284, 293, 282; 156/583.91, 583.8; 403/DIG. 8

See application file for complete search history.

(56) References Cited

U.S. PATENT DOCUMENTS

| | | | | |
|---|---|---|---|---|
| 6,058,834 | A * | 5/2000 | Beckwith | B30B 1/12 100/233 |
| 6,151,814 | A | 11/2000 | Raio et al. | |
| 2009/0242096 | A1 | 10/2009 | Robinson et al. | |

* cited by examiner

*Primary Examiner* — Elaine Gort
*Assistant Examiner* — Christopher B Wehrly
(74) *Attorney, Agent, or Firm* — Harness, Dickey & Pierce, PLC

(57) ABSTRACT

A press can include an upper platen, a lower platen, a support arm, and an adjuster. The support arm can be adapted to move the upper platen substantially parallel to the lower platen between an open position and a closed position. The adjuster can have a cam adapted to engage a surface of the support arm and to rotate between a first rotational position and a second rotational position relative to the support arm. Rotation of the cam from the first rotational position to the second rotational position can move the upper platen toward the lower platen.

23 Claims, 5 Drawing Sheets

DUAL PRESSURE CLAM PRESS

CROSS-REFERENCE TO RELATED APPLICATIONS

This application claims the benefit of U.S. Provisional Application No. 62/121,765, filed on Feb. 27, 2015. The entire disclosures of the above application is incorporated herein by reference.

FIELD

The present disclosure relates to a dual pressure clam press.

BACKGROUND

This section provides background information related to the present disclosure which is not necessarily prior art.

Heat and pressure printing and transfer applications often require two pressures to complete the operation. The process may require an application of a first (e.g. pre-heat or pre-cure) pressure, then an application of a second pressure. For example, the first pressure can be 40 psi and the second pressure can be 60 psi. Typical clam presses provide a single means of pre-setting the close pressure. Thus, only one close pressure is generally available per setting of the adjustment means. When using typical clam presses for applications that require two pressures, an operator can either pre-set two separate clam presses and move the work piece between the two clam presses, or must open and adjust the pre-set pressure of the single clam press after the first application of pressure. This can be time consuming, tedious, and costly. Thus, some operators pre-set the clam press to the higher of the two pressure settings and manually hold the clam press at a pressure that the operator approximates to be the lower pressure based on feel and experience. This method depends mainly on the skill and performance of the operator and can result in inconsistent pressure applications.

SUMMARY

This section provides a general summary of the disclosure, and is not a comprehensive disclosure of its full scope or all of its features.

A press can include an upper platen, a lower platen, a support arm, and an adjuster. The support arm can be adapted to move the upper platen substantially parallel to the lower platen between an open position and a closed position. The adjuster can have a cam adapted to engage a surface of the support arm and to rotate between a first rotational position and a second rotational position relative to the support arm. Rotation of the cam from the first rotational position to the second rotational position can move the upper platen toward the lower platen.

A press can include an upper platen, a lower platen, a base, a first member, a second member, a third member, and an adjuster. The lower platen can be mounted to the base. The first member can be rotatably coupled to the base. The second member can be rotatably coupled to the first member. The third member can be rotatably coupled to the second member and the base. The third member can support the upper platen and be adapted to move the upper platen between an open position and a closed position relative to the lower platen. The adjuster can have a cam rotatably coupled to the second member and one of the first or third members. The cam can be adapted to rotate between a first rotational position and a second rotational position relative to the second member. Rotation of the cam from the first rotational position to the second rotational position translates the second member relative to the one of the first or third members to move the upper platen toward the lower platen.

A method of operating a press can include a plurality of steps. The press can include an upper platen, a lower platen, a support arm that supports the upper platen for movement relative to the lower platen, and a cam member. The method can include inserting a workpiece between the upper platen and the lower platen. The method can include moving the support arm from an open position wherein the upper platen is spaced apart from the lower platen, to a closed position wherein the work piece is pressed between the upper and lower platens at a first pressure. The method can include rotating the cam member relative to the support arm from a first rotational position to a second rotational position to move the upper platen toward the lower platen.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

The clam press of the present disclosure eliminates guesswork and relieves the operator from tedious and frequent adjustments when performing dual pressure heat and pressure operations on a work piece. The clam press of this disclosure provides consistent pressing force at both a first pressure (e.g. low pressure) and a second pressure (e.g. high pressure) setting. The pressure differential between the first and second pressures is built into the clam press mechanism. After an initial application of the low pressure setting, the turn of a dial alternates pressing force between the low and high pressures.

Figure 1:
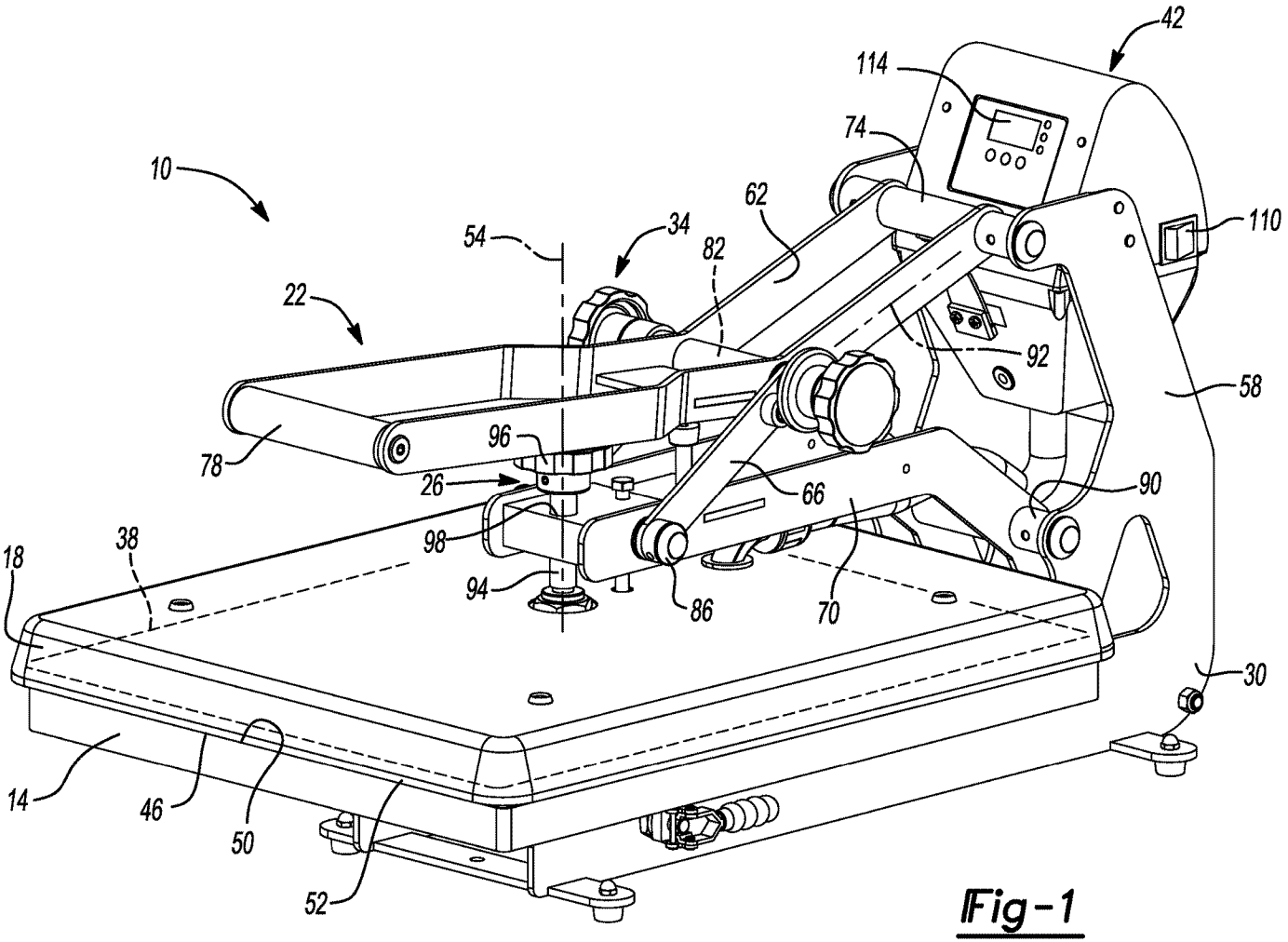
FIG. 1 is a perspective view of a clam press in accordance with the present teachings.
Figure 2:
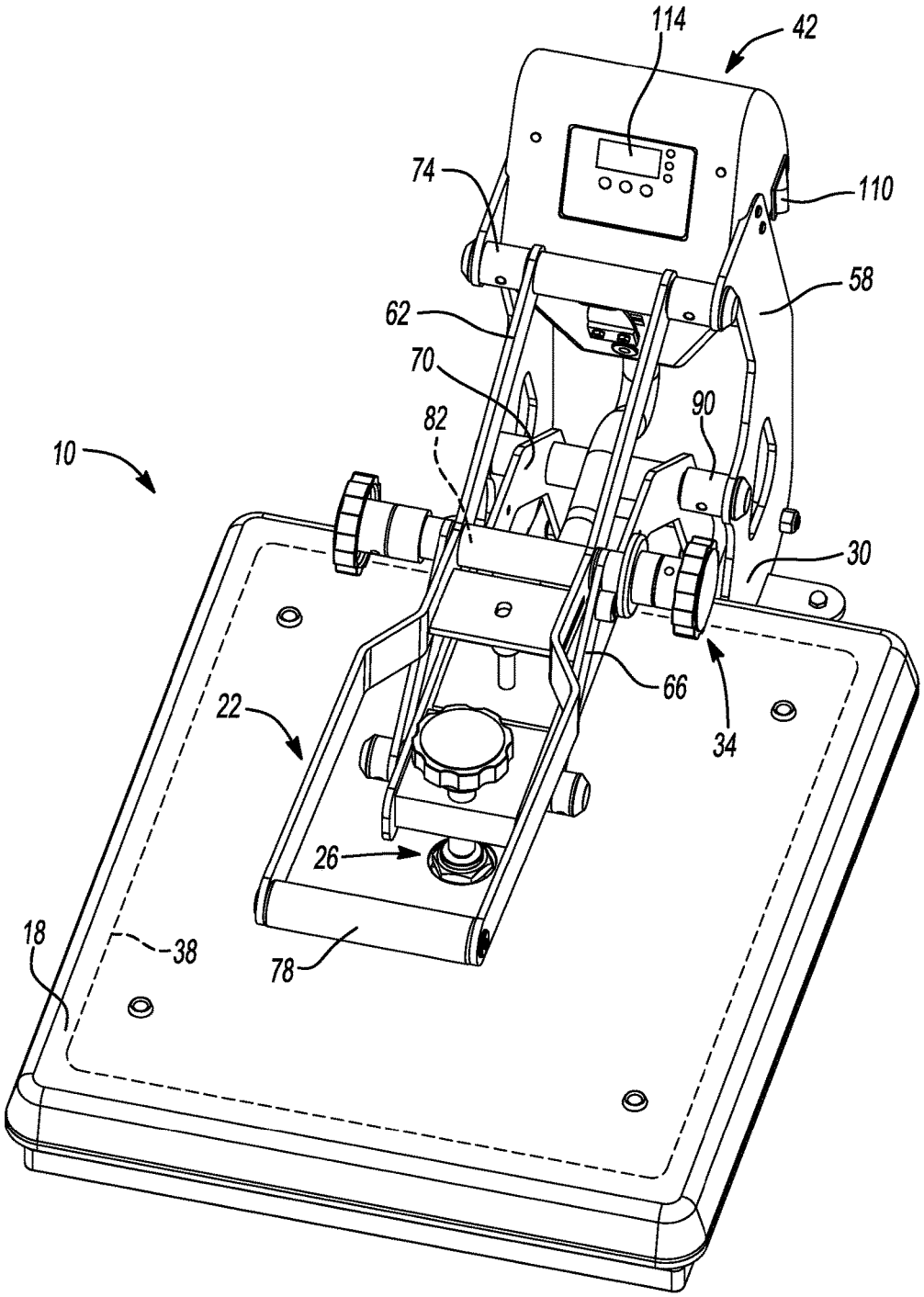
FIG. 2 is a second perspective view of the clam press of FIG. 1.
Figure 3:
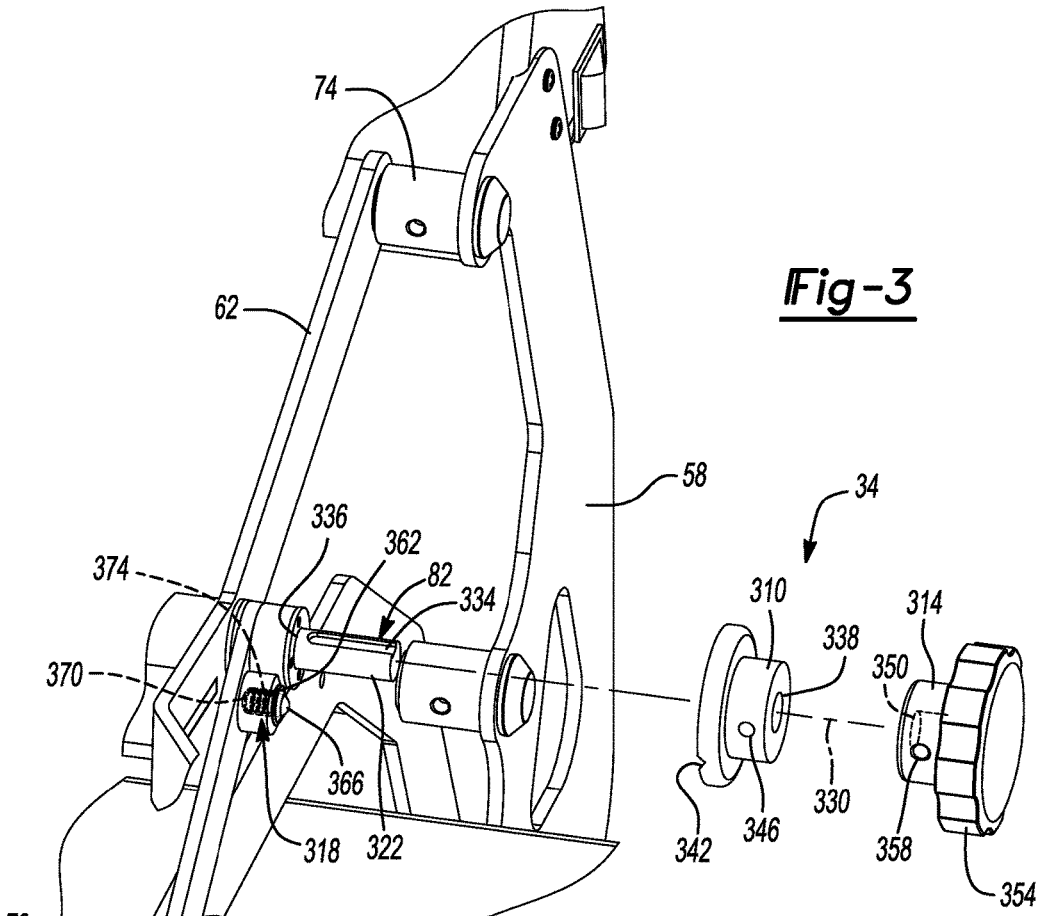
FIG. 3 is a partially exploded view of a portion of the clam press of FIG. 1, illustrating a dual pressure adjuster of the clam press.
Figure 4:
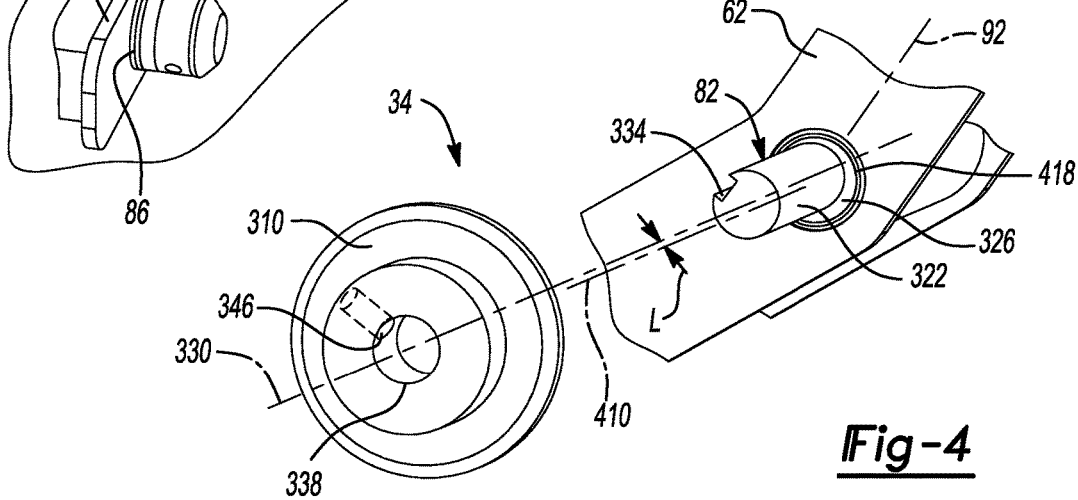
FIG. 4 is a partially exploded view of a portion of the clam press of FIG. 1, illustrating a cam mechanism of the dual pressure adjuster.
Figure 5:
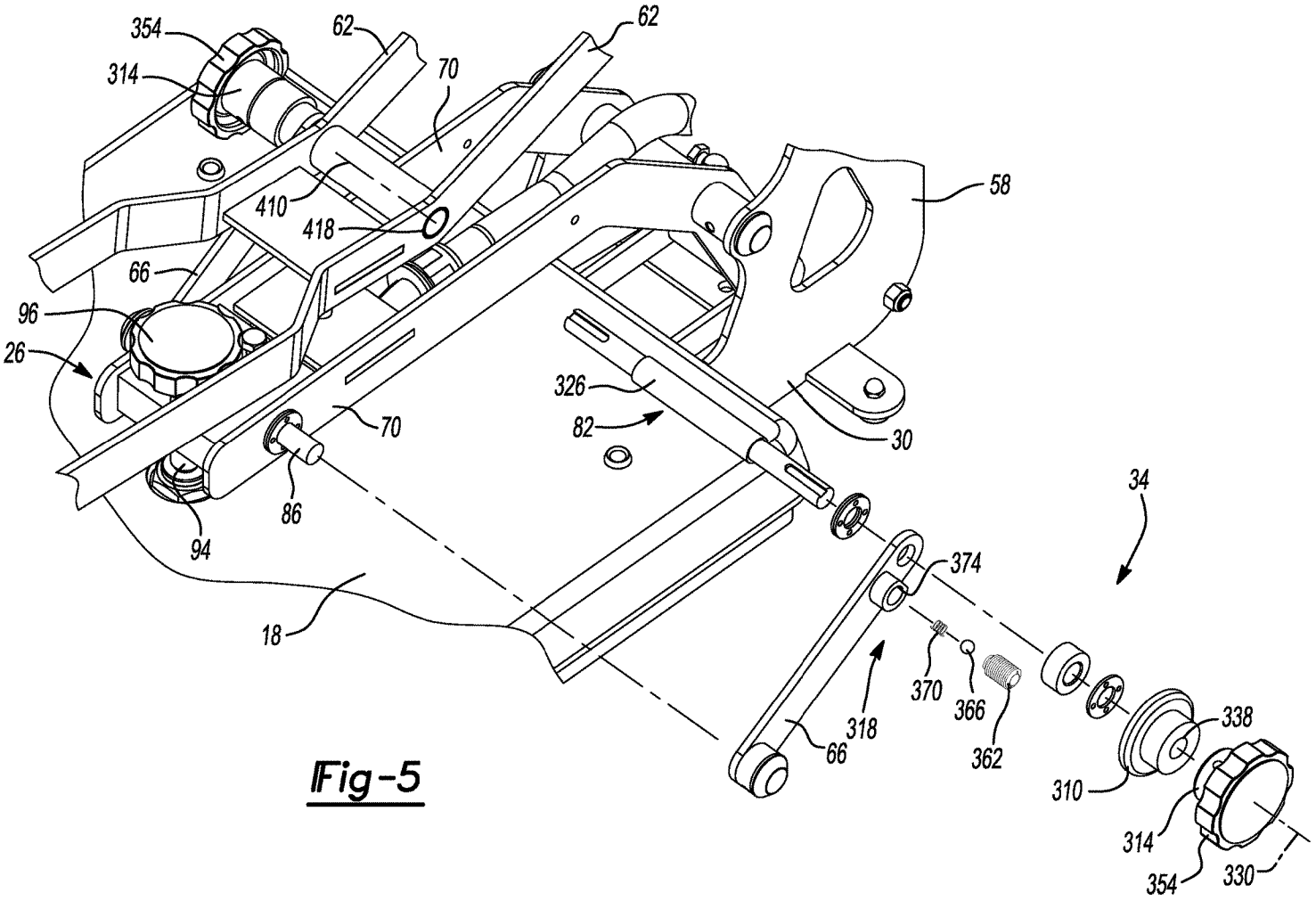
FIG. 5 is another partially exploded view of a portion of the clam press of FIG. 1, illustrating the cam mechanism of the dual pressure adjuster.
Figure 6:
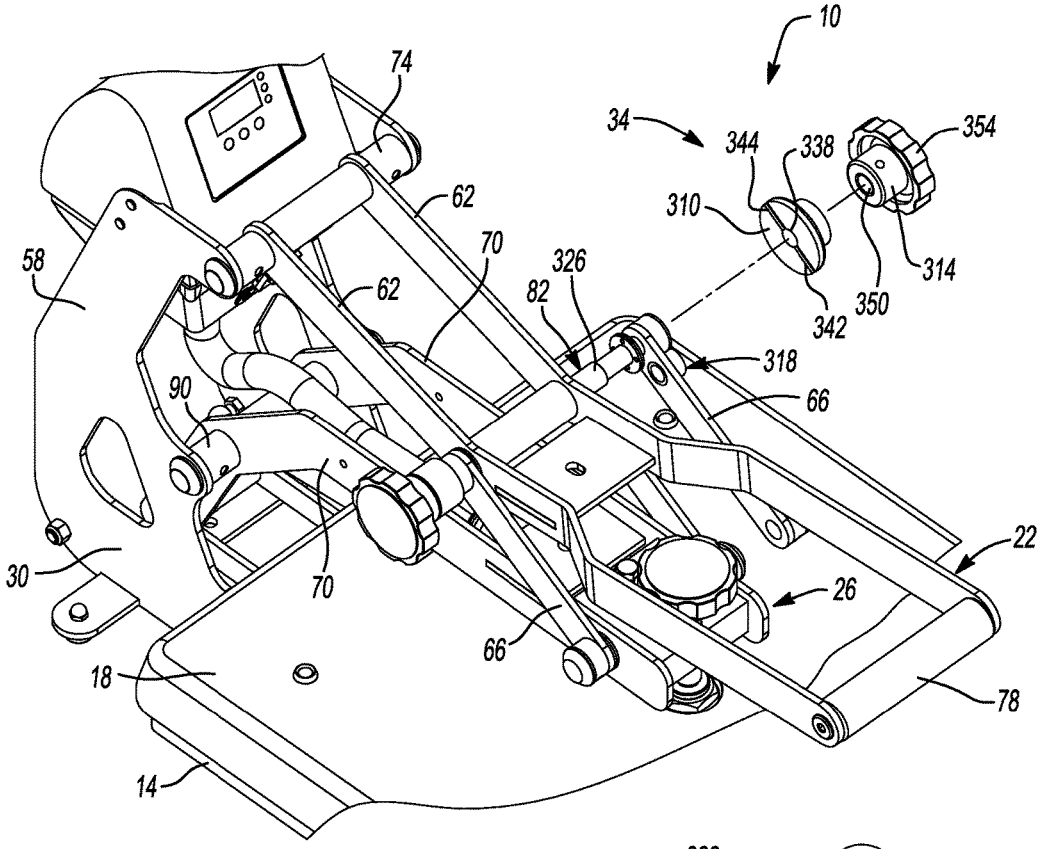
FIG. 6 is another partially exploded view of a portion of the clam press of FIG. 1, illustrating the cam mechanism of the dual pressure adjuster.
Figure 7:
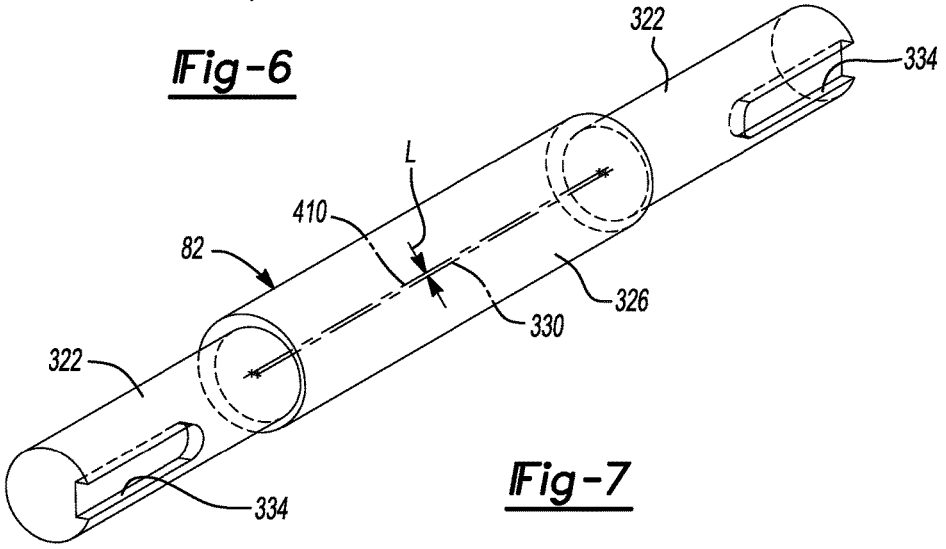
FIG. 7 is a perspective view of a portion of the cam mechanism of the clam press of FIG. 1.

With reference to FIGS. 1 and 2, a clam press 10 is illustrated in accordance with the present teachings. The clam press 10 is illustrated in a closed position. The clam press 10 can include a lower platen 14, an upper platen 18, an arm mechanism 22, a first adjustment mechanism 26, a base frame 30, a second adjustment mechanism 34, a heating element 38, and a control mechanism 42.

The lower platen 14 can be mounted on the base frame 30. The lower platen 14 can have a generally rectangular shape, though other configurations can be used. The lower platen 14 can have an upper face 46. The upper platen can be supported by the arm mechanism 22 generally above the lower platen 14. The upper platen 18 can have a generally rectangular shape, though other configurations can be used. The upper platen 18 can have a lower face 50 configured to oppose the upper face 46 of the lower platen 14. Additionally, the lower platen 14 and/or the upper platen 18 can include platen pads, such as insulating pad 52, for accommodating surface irregularities occurring on work pieces (not shown) to be inserted between the upper and lower platens 18, 14, such as fabric and a heat applied transfer for example.

The arm mechanism 22 can be pivotably supported by the base frame 30 and configured to move the upper platen 18 relative to the lower platen 14 generally toward and away from the lower platen 14. The arm mechanism 22 can be configured to move the upper platen 18 between an open position (not specifically shown) and a closed position (as shown in FIGS. 1 and 2). In the open position, the upper platen 18 can be spaced apart from the lower platen 14 to permit the work pieces to be positioned between the upper and lower platens 18, 14. In the closed position, the work pieces can be pressed between the lower and upper faces 46, 50. As the upper platen 18 approaches the closed position, the arm mechanism 22 can be configured to move the upper platen 18 generally along a first axis 54 that can be perpendicular to the lower platen 14.

The arm mechanism 22 can be a four bar linkage with an over center toggle mechanism to position and latch the clam press 10 in the closed position. The arm mechanism 22 can include a first link 58, a second link 62, a third link 66, and a fourth link 70. The first link 58 can be fixed to the base frame 30 and can be integrally formed therewith. A first pivot member 74 can pivotably couple the first and second links 58, 62. The second link 62 can define a handle 78 that can be spaced apart from the first pivot member 74 and can be used by the operator to move the arm mechanism 22 between the open and closed positions. A second pivot member 82 can pivotably couple the second and third links 62, 66 at a location along the second link 62 that can be between the first pivot member 74 and the handle 78. A third pivot member 86 can pivotably couple the third and fourth links 66, 70 at a location that is spaced apart from the second pivot member 82. A fourth pivot member 90 can pivotably couple the fourth link 70 to the first link 58 at a location that is spaced apart from the first and third pivot members 74, 86. The fourth link 70 can generally support the upper platen 18 for movement with the fourth link 70. The first, second, third, and fourth links 58, 62, 66, 70 can have lengths such that when the upper platen 18 is in the closed position, the arm mechanism 22 can be in a toggle, or locked position. In the toggle position, the second and third links 62, 66 can generally align longitudinally along a longitudinal axis 92 to lock the arm mechanism 22 and the upper platen 18 in the closed position. In other words, the first pivot member 74, the second pivot member 82, and the third pivot member 86, can be disposed along the longitudinal axis 92.

The first adjustment mechanism 26 can be configured to control the spacing between the lower platen 14 and the upper platen 18 in the closed position. The first adjustment mechanism 26 can include an adjustment screw 94 and a knob 96. The knob 96 can be non-rotatably coupled to the adjustment screw 94 and configured to be easily gripped by the operator. The upper platen 18 can be mounted to the adjustment screw 94. The adjustment screw 94 can have a set of external threads and can be received through an aperture 98 defined by the fourth link 70. The aperture 98 can have a set of internal threads configured to mate with the external threads of the adjustment screw 94, such that rotation of the adjustment screw 94 can cause the upper platen 18 to move along the first axis 54 relative to the fourth link 70. Thus, tightening the adjustment screw 94 can increase the pressure that is applied between the upper and lower platens 18, 14 when the upper platen 18 is in the closed position.

In the example provided, the heating element 38 is disposed within the upper platen 18. Alternatively or additionally, the heating element 38 can be disposed within the lower platen 14. The heating element 38 can be any suitable type of heating device, such as conventional resistive heating elements and the like, which may be formed as serpentine or otherwise wound throughout the surface area of the upper platen 18. The heating element 38 can be coupled to a typical power supply via the control mechanism 42.

The control mechanism 42 can include a thermocouple (not shown), a switch 110, and a display 114. The switch 110 can be configured to selectively provide power from the power source to the heating element 38. The thermocouple can be disposed within either of the upper or lower platens 18, 14 and can be configured to measure the temperature of the upper or lower platens 18, 14. The control mechanism 42 can be configured to control the temperature of the heating element 38, such as by controlling the electrical power supplied to the heating element 38. The display 114 can be configured to display information useful to the operator, such as temperature and time of operation for example. In the example provided, the display 114 is a digital display, though other configurations can be used.

The second adjustment mechanism 34 operates to effectively lengthen and shorten the third link 66. Extending the length of the third link 66 can decrease the spacing between the upper and lower platens 18, 14 when the upper platen 18 is in the closed position. Shortening the length of the third link 66 can increase the spacing between the upper and lower platens 18, 14 when the upper platen 18 is in the closed position.

With additional reference to FIGS. 3-7, the second adjustment mechanism 34 is illustrated in greater detail. The second adjustment mechanism 34 can include the second pivot member 82, a dial plate 310, a pair of knobs 314, and a detent mechanism 318. The second pivot member 82 can include a pair of pivot shafts 322 and a cam body 326. The pivot shafts 322 can be generally cylindrical shaped bodies disposed about a second axis 330. Each pivot shaft 322 can define a key slot 334 and can extend outward from opposite sides of the arm mechanism 22. The pivot shaft 322 can be rotatably received through an aperture 336 defined by the third link 66. The aperture 336 can be concentric with the pivot shaft 322.

The dial plate 310 can define an aperture 338, a first notch 342, and a second notch 344. The aperture 338 can extend through the dial plate 310 such that the dial plate 310 can receive one of the pivot shafts 322 through the aperture 338. The dial plate 310 can be configured to be rotationally fixed to the pivot shaft 322, such that the dial plate 310 and the pivot shaft 322 can be coupled for common rotation. In the example provided, the dial plate 310 defines an aperture 346 that extends radially through a portion of the dial plate 310 to intersect the aperture 338. The aperture 346 can receive a set screw (not shown) that is configured to engage the key slot 334 when the dial plate 310 is disposed about the pivot shaft 322. The set screw can couple the dial plate 310 and the pivot shaft 322 for common rotation. The first and second notches 342, 344 can be open on a side of the dial plate 310 that faces the third link 66. In the example provided, the first and second notches 342, 344 can be generally V-shaped, though other configurations can be used. By way of some non-limiting examples, such alternative configurations can include detent holes, apertures, or indents formed in the side of the dial plate 310 that faces the third link 66. The first and second notches 342, 344 can be circumferentially spaced apart by an angle that corresponds to desired first and second rotational positions of the cam body 326, as will be discussed below. In the particular example provided, the first and second notches 342, 344 are spaced apart by 180 degrees. It is understood that the dial plate 310 can define additional notches (not specifically shown) which can be similar to the first and second notches 342, 344 and can correspond to additional positions of the cam body 326.

The knob 314 can define an aperture 350 and a handle 354. The aperture 350 can extend into the knob 314 and can be configured to receive one of the pivot shafts 322, such that the dial plate 310 can be positioned axially between the third link 66 and the knob 314. The knob 314 can be configured to be rotationally fixed relative to the pivot shaft 322. In the example provided, the knob 314 defines an aperture 358 that extends radially through a portion of the knob 314 to intersect the aperture 350. The aperture 358 can receive a set screw (not shown) that is configured to engage the key slot 334 when the knob 314 is disposed about the pivot shaft 322. The set screw can couple the knob 314 and the pivot shaft 322 for common rotation. Alternatively, the knob 314 can be mounted to or integrally formed with the dial plate 310. For example, the knob 314 can have a key integrally formed in the aperture 350, or inserted therein to fit in and engage the key slot 334. The handle 354 can be configured to be easily gripped by the operator.

The detent mechanism 318 can be coupled to the third link 66 for common movement therewith and configured to engage the first and second notches 342, 344 of the dial plate 310. The detent mechanism 318 can include a housing 362, a plunger 366, and a biasing member 370. The housing 362 can be mounted to the third link 66. Alternatively, the housing 362 can be integrally formed with the third link 66. The housing 362 can define a cavity 374 that can be open toward the dial plate 310. The plunger 366 can be received in the cavity 374 and can be configured to partially extend out from the housing 362 to be received by and engage with one of the first and second notches 342, 344. The biasing member 370 can be received in the cavity 374 and configured to bias the plunger 366 outward toward the dial plate 310. In the example provided, the plunger 366 is a spherical body (e.g. a ball), though other configurations can be used, such as a shaft like body having a rounded head for example. In the example provided, the biasing member 370 is a coil spring, though other configurations can be used. Thus, the biasing member 370 can bias the plunger 366 into engagement with the notches 342, 344 to inhibit rotation of the dial plate 310 when rotated to the first or second rotational positions of the cam body 326, as will be discussed below.

The cam body 326 can have a generally cylindrical shape disposed about a third axis 410 that is parallel to and offset from the second axis 330 by a radial distance L. The cam body 326 can be coupled to the pivot shaft 322 for common rotation therewith. The cam body 326 can be fixedly coupled to or integrally formed with the pivot shaft 322. The cam body 326 can be rotatably received in an aperture 418 defined by the second link 62. The aperture 418 can be coaxial with the cam body 326 about the third axis 410. Thus, rotation of the cam body 326 within the aperture 418 can cause the pivot shaft 322 to pivot about the third axis 410. Since the pivot shaft 322 is centered about the second axis 330, half of a full rotation of the cam body 326 about the third axis 410 can cause the pivot shaft 322 and the third link 66 to move a total radial distance of 2*L. In the example provided, the first and second rotational positions of the cam body 326 is such that the third link 66 is closest to the first pivot member 74 when the cam body 326 is in the first rotational position, and furthest from the first pivot member 74 when in the second rotational position. In other words, when the arm mechanism 22 is in the toggle position (e.g. the third link 66 aligns with the second link 62 along the longitudinal axis 92), the effective length of the third link 66 increases by a distance of 2*L when the knob 314 is rotated to move the cam body 326 from the first rotational position to the second rotational position. Thus, rotation of the second pivot member 82 can simulate the lengthening and shortening of the third link 66 and the throw of the cam body 326 (e.g. the distance L) controls the pressure differential between a low and high pressure setting. The first notch 342 can align with the plunger 366 of the detent mechanism 318 when the cam body 326 is in the first rotational position and the second notch can align with the plunger 366 when the cam body 326 is in the second rotational position.

In an alternative construction, not specifically shown, the adjustment mechanism 34 can be located at the third pivot member 86, instead of the second pivot member 82. This alternative construction can be similar to that shown in FIGS. 1-7 and described above, except that the third pivot member 86 can include the pair of pivot shafts 322 and the cam body 326.

In operation, the operator can set the first adjustment mechanism 26 to the first or low pressure while the clam press 10 is in the open position. The operator can then insert the work pieces between the upper and lower platens 18, 14, and manipulate the handle 78 of the arm mechanism 22 until the clam press 10 is in the closed position at the first pressure. When the second pressure is desired, the operator does not need to adjust the first adjustment mechanism 26. The operator need only open the clam press 10, and turn the knob 314 to move the cam body 326 from the first rotational position to the second rotational position. The detent mechanism 318 and dial plate 310 can hold the cam body 326 in the first and second rotational positions.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A heat press for applying a heat transfer to a material, comprising:

an upper platen;

a lower platen;

a support arm coupled to the upper platen and configured to move the upper platen between an open position and a closed position relative to the lower platen, said support arm including a first link fixedly-positioned relative to the lower platen, a second link rotatably coupled to the first link, a third link rotatably coupled to the second link, and a fourth link rotatably coupled to the third link and the first link;

a first pressure adjustment mechanism configured to facilitate adjustment of an amount of pressure applied between the lower platen and the upper platen when in the closed position; and a second pressure adjustment mechanism configured to facilitate adjustment of an amount of pressure applied between the lower platen and the upper platen when in the closed position;

wherein the second pressure adjustment mechanism includes a cam configured to rotate between a first rotational position and a second rotational position to increase a distance between the second link and the fourth link along the third link, thereby increasing an amount of pressure between the lower platen and the upper platen when in the closed position.

2. The heat press of claim 1, wherein the first pressure adjustment mechanism includes an adjustment screw that couples the upper platen to the support arm.

3. The heat press of claim 1, wherein the second pressure adjustment mechanism is positioned at a location on the support arm that does not include the location where the support arm is coupled to the upper platen.

4. The heat press of claim 1, further comprising a means for holding the cam in the first and second rotational positions.

5. The heat press of claim 1, wherein the second pressure adjustment mechanism is positioned at the location where the second link is rotatably coupled to the third link.

6. The heat press of claim 1, wherein the second pressure adjustment mechanism is positioned at the location where the third link is rotatably coupled to the fourth link.

7. The heat press of claim 1, wherein:

the cam includes a cylindrical cam body extending along a cam body axis, the cam body being coupled to a pivot shaft;

the cam body is rotatably received in a cylindrical aperture in the second link, the cam body and cylindrical aperture being coaxial;

the pivot shaft is rotatably received through an aperture in the third link; and rotation of the cam body within the cylindrical aperture in the second link causes the pivot shaft to pivot about the cam body axis.

8. The heat press of claim 1, wherein:

the cam includes a cylindrical cam body extending along a cam body axis, the cam body being coupled to a pivot shaft;

the cam body is rotatably received in a cylindrical aperture in the fourth link, the cam body and cylindrical aperture being coaxial;

the pivot shaft is rotatably received through an aperture in the third link; and rotation of the cam body within the cylindrical aperture in the fourth link causes the pivot shaft to pivot about the cam body axis.

9. A heat press for applying a heat transfer to a material, comprising:

an upper platen;

a lower platen;

a support arm coupled to the upper platen and configured to move the upper platen between an open position and a closed position relative to the lower platen;

a first pressure adjustment mechanism configured to facilitate adjustment of an amount of pressure applied between the lower platen and the upper platen when in the closed position through a continuous range of possible pressures; and a second pressure adjustment mechanism configured to facilitate adjustment of an amount of pressure applied between the lower platen and the upper platen when in the closed position, wherein the second pressure adjustment mechanism includes a cam configured to rotate between a first rotational position and a second rotational position.

10. The heat press of claim 9, wherein the first pressure adjustment mechanism includes an adjustment screw that couples the upper platen to the support arm.

11. The heat press of claim 9, wherein the second pressure adjustment mechanism is configured to change an amount of pressure applied between the lower platen and the upper platen when in the closed position from a first amount of pressure when the cam is in the first rotational position to a second amount of pressure when the cam is in the second rotational position.

12. The heat press of claim 9, wherein the second pressure adjustment mechanism is positioned at a location on the support arm that does not include the location where the support arm is coupled to the upper platen.

13. The heat press of claim 9, further comprising a means for holding the cam in the first and second rotational positions.

14. The heat press of claim 9, wherein the second pressure adjustment mechanism is positioned at the location where the second link is rotatably coupled to the third link.

15. The heat press of claim 9, wherein the second pressure adjustment mechanism is positioned at the location where the third link is rotatably coupled to the fourth link.

16. The heat press of claim 9, wherein:

the cam includes a cylindrical cam body extending along a cam body axis, the cam body being coupled to a pivot shaft;

the cam body is rotatably received in a cylindrical aperture in the second link, the cam body and cylindrical aperture being coaxial;

the pivot shaft is rotatably received through an aperture in the third link; and rotation of the cam body within the cylindrical aperture in the second link causes the pivot shaft to pivot about the cam body axis.

17. The heat press of claim 9, wherein:

the cam includes a cylindrical cam body extending along a cam body axis, the cam body being coupled to a pivot shaft;

the cam body is rotatably received in a cylindrical aperture in the fourth link, the cam body and cylindrical aperture are coaxial;

the pivot shaft is rotatably received through an aperture in the third link; and rotation of the cam body within the cylindrical aperture in the fourth link causes the pivot shaft to pivot about the cam body axis.

18. A heat press for applying a heat transfer to a material, comprising:

an upper platen;

a lower platen;

a support arm coupled to the upper platen and configured to move the upper platen between an open position and a closed position relative to the lower platen, said support arm including a first link fixedly-positioned relative to the lower platen, a second link rotatably coupled to the first link, a third link rotatably coupled to the second link, and a fourth link rotatably coupled to the third link and the first link;

a first pressure adjustment mechanism configured to facilitate adjustment of an amount of pressure applied between the lower platen and the upper platen when in the closed position; and a second pressure adjustment mechanism configured to facilitate adjustment of an amount of pressure applied between the lower platen and the upper platen when in the closed position;

wherein:

the second pressure adjustment mechanism includes a cam configured to rotate between a first rotational position and a second rotational position;

the cam includes a cylindrical cam body extending along a cam body axis, the cam body being coupled to a pivot shaft;

the cam body is rotatably received in a cylindrical aperture in the second link, the cam body and cylindrical aperture are coaxial;

the pivot shaft is rotatably received through an aperture in the third link; and rotation of the cam body within the cylindrical aperture in the second link causes the pivot shaft to pivot about the cam body axis.

19. The heat press of claim 18, wherein the first pressure adjustment mechanism includes an adjustment screw that couples the upper platen to the support arm.

20. The heat press of claim 18, wherein the second pressure adjustment mechanism is configured to change an amount of pressure applied between the lower platen and the upper platen when in the closed position from a first amount of pressure when the cam is in the first rotational position to a second amount of pressure when the cam is in the second rotational position.

21. The heat press of claim 18, wherein the second pressure adjustment mechanism is positioned at a location on the support arm that does not include the location where the support arm is coupled to the upper platen.

22. The heat press of claim 18, further comprising a means for holding the cam in the first and second rotational positions.

23. The heat press of claim 18, wherein the second pressure adjustment mechanism is positioned at the location where the second link is rotatably coupled to the third link.

* * * * *